US005344024A

United States Patent [19]

Cohu

[11] Patent Number: 5,344,024

[45] Date of Patent: Sep. 6, 1994

[54] CASE FOR STORING, ORGANIZING AND SORTING SMALL ARTICLES

[76] Inventor: Gary D. Cohu, P.O. Box 28252, Kansas City, Mo. 64118

[21] Appl. No.: 128,464

[22] Filed: Sep. 28, 1993

[51] Int. Cl.[5] ..... B07C 7/04; B07C 5/00; B65D 85/00

[52] U.S. Cl. ..... 206/526; 209/702; 209/706; 220/526

[58] Field of Search ..... 206/526; 220/526, 23.4; 209/702, 706

[56] References Cited

U.S. PATENT DOCUMENTS

| | | | |
|---|---|---|---|
| D. 246,508 | 11/1977 | Nudell | D9/183 |
| D. 281,836 | 12/1985 | Sparkman | D3/74 |
| D. 308,915 | 7/1990 | Lanius | D3/38 |
| 2,707,839 | 5/1955 | Green, Jr. . | |
| 2,711,050 | 6/1955 | McIntyre | 206/315.11 |
| 3,016,129 | 1/1962 | King, III . | |
| 4,314,650 | 2/1982 | Cillario | 206/526 |
| 4,589,546 | 5/1986 | Sunderland | 206/315.11 |
| 4,643,316 | 2/1987 | Hoffmann | 209/702 |
| 4,972,625 | 11/1990 | Barnes | 43/57.1 |
| 4,974,746 | 12/1990 | Dickinson | 209/702 |
| 5,027,972 | 7/1991 | Bartholomew | 220/526 |
| 5,163,578 | 11/1992 | Eitreim et al. | 220/526 |
| 5,181,619 | 1/1993 | Noble | 209/706 |
| 5,277,329 | 1/1994 | Pomroy et al. | 220/526 |

*Primary Examiner*—William I. Price
*Attorney, Agent, or Firm*—Kenneth W. Iles

[57] ABSTRACT

A case for organizing and sorting small articles includes a body and a hinged lid with a latch mechanism for closing securely. A plurality of web portions in the inside surface of the lid align with matching web portions in the inside surface of the bottom of the case, forming a plurality of cells in the lid and bottom of the case. An article container fits into each cell, and is sealed at the top by the case lid when it is closed, and is restrained from movement by the top and bottom web. The top surface of the lid includes a recessed article sorting tray, which tapers as a funnel toward the rear of the case and terminates in a chute. An article container is placed in a recessed loading channel at the rear of the body. Small articles can be sorted or selected in the sorting tray in the case top and then returned to the container by lifting the lid.

20 Claims, 4 Drawing Sheets

CASE FOR STORING, ORGANIZING AND SORTING SMALL ARTICLES

BACKGROUND OF THE INVENTION

1. Field of the Invention

The present invention is related to an apparatus for storing and sorting small articles. More particularly, the present invention is directed to a portable case having a plurality of internal cells for storing different articles and a sorting tray in the lid with a chute for returning the articles to one of the internal cells.

2. Description of Related Art Including Information Disclosed Under 37 C.F.R. Sections 1.97–1.99

Many people work with large numbers of small parts or articles. Electronics' technicians, plumbers, handymen and many other people use large numbers of small parts or articles, which they like to keep sorted by some category, e.g., resistors, capacitors, different sized rubber or metal washers, different sizes of screws, nuts and other fasteners. It is frequently desired to carry an assortment of such articles to a job site, e.g., from a service van to a customer's building. When selecting a particular article for use, it is frequently necessary to empty a container, such as a small box, and sort through the contents to locate the desired article. Then the remaining articles must be returned to the container. Typically, the worker scoops the articles into his hands, a time-consuming and tedious chore, which can also lead to loosing parts. Containers for such articles typically either have open tops, which can led to spilling the contents, or a lid, which is awkward to use and, if detachable, may be lost.

Efforts to provide an easily used apparatus or system for storing articles, keeping them separated according to some classification scheme, making them readily accessible and providing a simple, quick and effective means for returning the remaining articles to their separate containers when a particular class of articles is no longer needed have been partial and fall short of providing the convenience desired by potential users. Some examples of related efforts to address these needs are reflected in issued United States patents, some of which are discussed below.

U.S. Pat. No. 4,972,625, issued to Barnes on Nov. 27, 1990, discloses a "Tackle Holder" comprising a case having a lid pivotally attached to the case by a hinge and fastenable by a latch on the front of the case. A plurality of individual containers, or cells fits inside the case. The cells have the appearance of elongated egg crate cells or beehive cells. The cells are formed by a plurality of interlocking corrugated partitions arranged side by side in opposite pairs which are mirror images of one another.

Design U.S. Pat. No. 308,915, issued to Lanius on Jul. 3, 1990, discloses a "Tackle Box" having an apparently raised pattern on the lid and a plurality of individual storage cells on a shelf inside the case. The cell walls do not reach the inside surface of the lid.

U.S. Pat. No. 4,589,546, issued to Sunderland on May 20, 1986, discloses a "Fishing Lure Storage and Transportation Structure" comprising a case having a lid and a plurality of storage cells inside the case.

Design U.S. Pat. No. 281,836, issued to Sparkman on Dec. 24, 1985, discloses a "Medical Case" comprising a case having a plurality of removable small cells on a shelf inside the case, with each cell having its own individual lid.

Design U.S. Pat. No. 246,508, issued to Nudell on Nov. 29, 1977, discloses a "Pill Box" comprising a case having a lid and three interior cells, with three windows in the lid.

U.S. Pat. No. 3,016,129, issued to King III on Jan. 9, 1962, discloses an "Insulated Carrying Case for Heated Frozen Food Dinners and the Like" comprising case having a hinged lid with two latches and a carrying handle on the front of the case. The interior of the case includes three depressions in the bottom of the case, which match mirror image cells in the lid. The perimeters of the matching cells touch and engage one another when the case is closed. The clearance between the corresponding ridges and grooves of the perimeters of the bottom cells and the perimeters of the upper cells is sufficient to pinch the gasket material together, which prevents the contents of the different cells from mixing.

U.S. Pat. No. 2,707,839, issued to Green, Jr. on May 10, 1955, discloses a "Display Kit for Colored Carpet Samples and the Like" comprising a case having a hinged lid with two latches and a carrying handle on the front of the case, and a plurality of cells in the bottom and the top of the case.

These references show of a case having a hinged lid secured by latches and a pivoting handle on the front of the cases for carrying the case and the use of a plurality of internal cells for holding separate items without mixing them. Also shown is the use of individually removable cells or containers seated within a case, as is the use of matching cell perimeters in the base and lid of a case that seal the cells at the top when the lid is closed.

These references, however, do not disclose a good way for sorting articles from a particular container, or a simple, reliable means for returning articles to an individual container after sorting, or a truly spill-proof permanent means for sealing individual containers when the case is closed.

Therefore, a need exists for a case that provides a truly spill-proof permanent means for sealing individual containers when the case is closed; that provides a good way for sorting articles from a particular container, and that provides a simple, reliable means for returning articles to an individual container after sorting.

SUMMARY OF THE INVENTION

Accordingly, it is a primary object of the present invention to provide a case for storing, organizing and sorting small articles that holds a plurality of small article containers having open tops without allowing articles to spill from the containers when the case is closed.

It is a further object of the present invention to provide a case for storing, organizing and sorting small articles including a means for facilitating sorting of the small articles from an article container conveniently, that is, without risk of scattering the articles widely.

It is a further object of the present invention to provide a case for storing, organizing and sorting small articles that includes a means for easily returning articles not selected to a container.

The invention comprises a case for storing, organizing and sorting small articles having a lid hinged along the rear side of the box or case that can be secured with a latch, much like a tool box or briefcase. The case for storing, organizing and sorting small articles is an organizer that makes it easy to store and sort a variety of small parts or pieces in separate containers without spilling or mixing pieces regardless of the manner in which the closed handy-caddie is handled or oriented. Further, the case permits the user to dump selected pieces for sorting and access into a special sorting tray build into the lid, to select the desired piece, and then to return the articles to the case for storage through a convenient chute when the selection process is complete.

The case is intended for use by anyone who needs to keep a plurality of small pieces separated and organized, while simultaneously being accessible, such as appliance repairmen, electronics repairmen, plumbers, household handymen, and the like.

The present invention includes the following features. A plurality of small containers, preferably in the shape of a rectangular solid, fit inside the case and are received in a web upstanding from the floor of the case and defining a plurality of ridges having the shape and size of the perimeter of each small container. A matching and superposed web is located in the lower or inside surface of the lid. The lid and case are sized such that each small container is held firmly by the opposed and superposed webs of the lid and case bottom when the lid is closed. Thus the lower surface of the lid serves as a lid for each of the small containers when the case lid is closed. Thus secured at the top and the bottom, the small containers will not spill their contents regardless of their spatial orientation or how vigorously the case is handled.

The upper, or top, surface of the lid includes a recessed sorting tray having a V-shaped chute that faces the rear of the case. An article pick up ramp rises from the recessed floor of the sorting tray to the same level as the top of the lid to permit the user to easily pick up small parts from the recessed sorting tray by sliding them to the edge of the lid and then picking up the part.

The V-shaped tunnel-chute continues through a tunnel located at the back of the lid. The tunnel penetrates through to the back edge of the lid, allowing parts to slide from the recessed tray to the back edge of the lid, and then out and down from the case. The V-shaped chute funnels the parts into the tunnel when the lid is raised along the front edge, as when the lid is opened. The angle of the V-shape has been carefully selected to permit the parts to be funneled in the tunnel-chute without clogging the chute. The surface of the recessed sorting tray is pebbled to increase the friction between the parts and the tray to improve the emptying function and to make it easier to pick up selected articles from the sorting tray.

Along the back of the case is a channel having straight parallel vertical sides aligned with and the same width as the tunnel-chute, and is also the same width of each side wall of the article containers that are seated inside the case. This channel serves as a locator, which allows the user to align an article container with the tunnel-chute without even looking at the back of the case, then slowing raising the lid to return the contents of the recessed sorting tray to the article container, which is then returned to the case for storage.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE PREFERRED EMBODIMENTS

As required by the Patent Statutes and the case law, the preferred embodiment of the present invention and the best mode currently known to the inventor for carrying out his invention are disclosed in detail herein. The embodiments disclosed herein, however, are merely illustrative of the invention, which may be embodied in various forms. Therefore, specific structural and functional details disclosed herein are not to be interpreted as limiting, but merely to provide the proper basis for the claims and as a representative basis for teaching one skilled in the art to which the invention pertains to make and use the apparatus and process disclosed herein as embodied in any appropriately specific and detailed structure.

Figure 1:
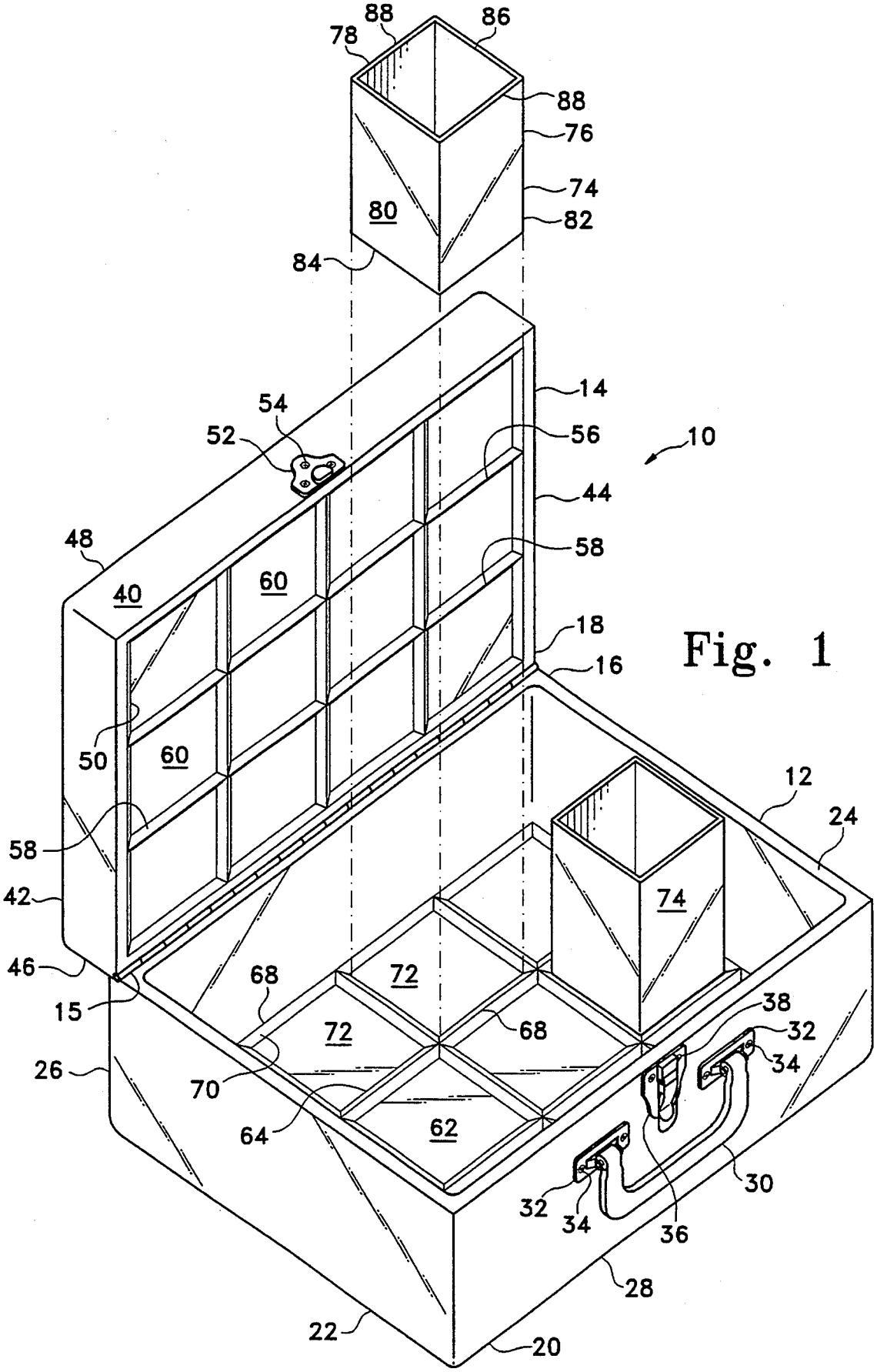
FIG. 1 is a front-right perspective view of the case for storing and organizing small articles, illustrating the case in the open position and two small article containers.

Referring to FIG. 1, there is shown a case for storing and organizing small articles (hereinafter "case") 10, having a body 12 and a lid 14 secured to the body 12 by a piano hinge 15 along a rear top edge 16 of the body 12 and along a rear bottom edge 18 of the lid 14 by screws or other fasteners. The body 12 includes a front wall 20, a left-hand side wall 22, a right-hand side wall 24, a rear wall 26 and a bottom wall 28. A handle 30 is secured to the front wall 20 of the body 12 by a pair of brackets 32 secured by screws 34 or other fasteners. An element of a latch mechanism 36 is secured to an upper portion of the body 12 by screws 38 or other fasteners. The lid 14 includes a front wall 40, a left-hand side wall 42, a right-hand side wall 44, a rear side wall 46, a top side wall 48 and a bottom wall 50. Another element of a latch mechanism 52 is secured to the front wall 40 of the lid 14 by screws 54 or other fasteners in a location near the middle of the front wall 40 along a lower portion of the front wall 40. The lid 14 pivots about the piano hinge 15 relative to the body 12, allowing the lid 14 to be opened and closed. The elements of the latch mechanism 36, 52 can be fastened together when the lid 14 is closed to maintain the case 10 in the closed position. The latch mechanisms 36, 52 can be released by the user when the case 10 is to be opened.

Still referring to FIG. 1, the bottom wall 50 of the lid 14 includes a web 56, consisting of a plurality of raised ribs 58 forming by perpendicular lines that divide the plane of the bottom wall 50 of the lid 14 into a grid defining twelve cells 60. The resulting upper grid in the lid 14 is aligned directly above a matching bottom grid in an upper surface 62 of the bottom wall 28 of the body 12 when the case 10 is closed. The bottom grid is similarly formed from a web 64 formed from a plurality of raised ribs 68 formed by perpendicular web members 70 in the form of straight lines, which divide the plane of the upper surface 62 of the bottom wall 28 of the body 12 into twelve cells 72.

Still referring to FIG. 1, an article container 74 includes a front wall 76, a rear wall 78, a left-hand side wall 80, a right-hand side wall 82, and a bottom wall 84, forming a rectilinear volume. Each of the side walls 80, 82, and the front wall 76 and rear wall 78 have the same dimensions so that each side of the article container 74 appears the same. The article container 74 has an open top 86, whose perimeter defines a square, and no lid. The bottom wall 84 of the article container 74 fits inside any one of the cells 72 in the bottom of the body 12. Twelve article containers 74 can be seated in the twelve cells 72 of the bottom of the body 12. Desired articles can be placed in each of the twelve article containers 74 and sorted and organized in any desired manner within each article container 74 and individual article containers 74 can be arranged in any desired manner within the cells 72 in the upper surface 62 of the bottom wall 28 of the body 12 because each article container 74 is the same size and each cell 72 is also of the same size and is designed to accept the bottom wall 84 of any article container 74. As is apparent from the drawings, the article containers 74 are removable containers 74 that are not fastened into the case 12 in any fashion. The user can therefore easily and readily remove any article container 74 from the case 12, and then replace it within any desired cell 72 in the bottom of the body 12 when desired.

Still referring to FIG. 1, when the lid 14 is closed, the cells 60 in the lid 14 align with each of the article containers 74 that are seated in the bottom of the case 12. The raised ribs 58 of that form the web 56 form a seal about the perimeter of the top 86 of each article container 74, which prevents the contents of any article container 74 from spilling regardless of the orientation of the case 12 after it is closed and latched. This result depends on manufacturing the case 12 and the included article containers 74 to close tolerances so that the lid 14 can be closed when the article containers 74 are inside, but the interior or lower surface of the lid 14 touches or very nearly touches the upper edges 88 along the top 86 of each article container 74, so that the raised ribs 58 effectively seal the tops 86 of the article containers 74. The raised ribs 68 forming the web 64 in the bottom of the body 12 locate the article containers 74 in the bottom of the body 12, which both locates each article container to insure that it is aligned with the web 56 in the lid 14 prior to closing, and prevents the bottom portion of each article container 74 from shifting from its proper sealing position during movement of the case 12. Thus each article container 74 is restrained from movement outside the cell it is seated in by the raised ribs 58 operating on the top of each article container 74 and by the raised ribs 68 in the bottom of the case 12 operating to secure to bottom of each article container 74. Therefore, no article container 74 can shift within the closed case 12, regardless of the orientation of the case 12. Combined with the sealing function of the web 56, articles within any article container 74 cannot escape from the article container 74, regardless of the orientation of the case 12.

The case 12 can be made of any suitable material, including metal, or, preferably, plastic. The webbing in the top and bottom of the case may be integrally formed as part of the walls of the case 12, which provides the greatest quality of tolerances and so forth, or may be inserts that are placed into a hollow lid portion and the bottom of a case and fixed therein. The article containers 74 are preferably injected molded from transparent plastic. Use of transparent plastic facilitates identification of the contents of each article container by the user.

Figure 7:
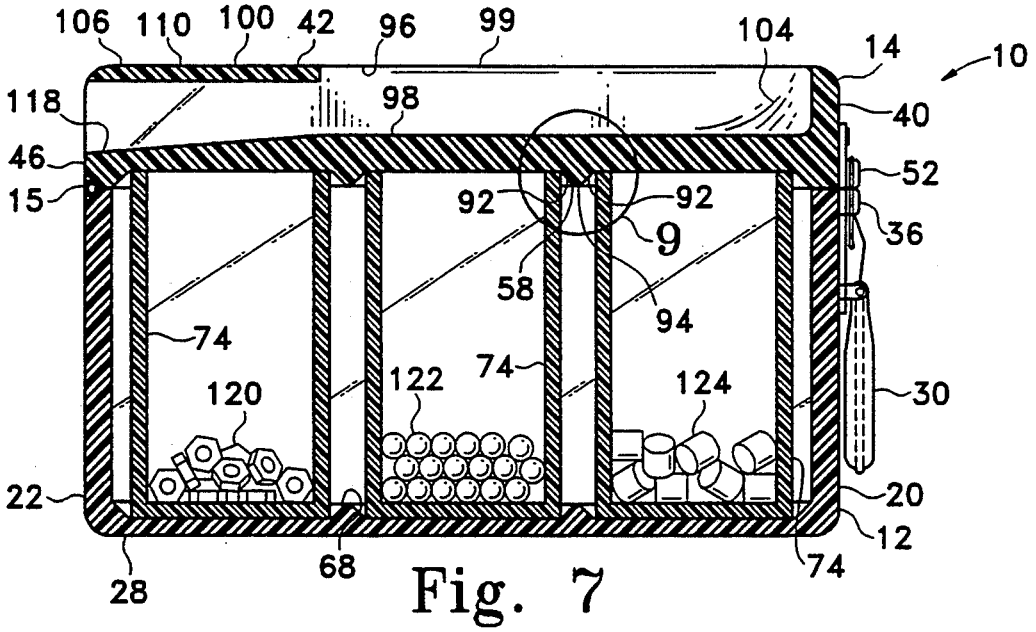
FIG. 7 is a left side cross section elevation illustrating the case in the closed position and operation of aligned opposing webs in the inner surface of the lid and the bottom to maintain each internal container in a sealed condition.
Figure 9:
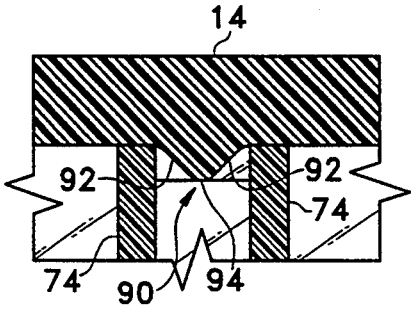
FIG. 9 is an enlarged view of a portion of FIG. 7.
Figure 8:
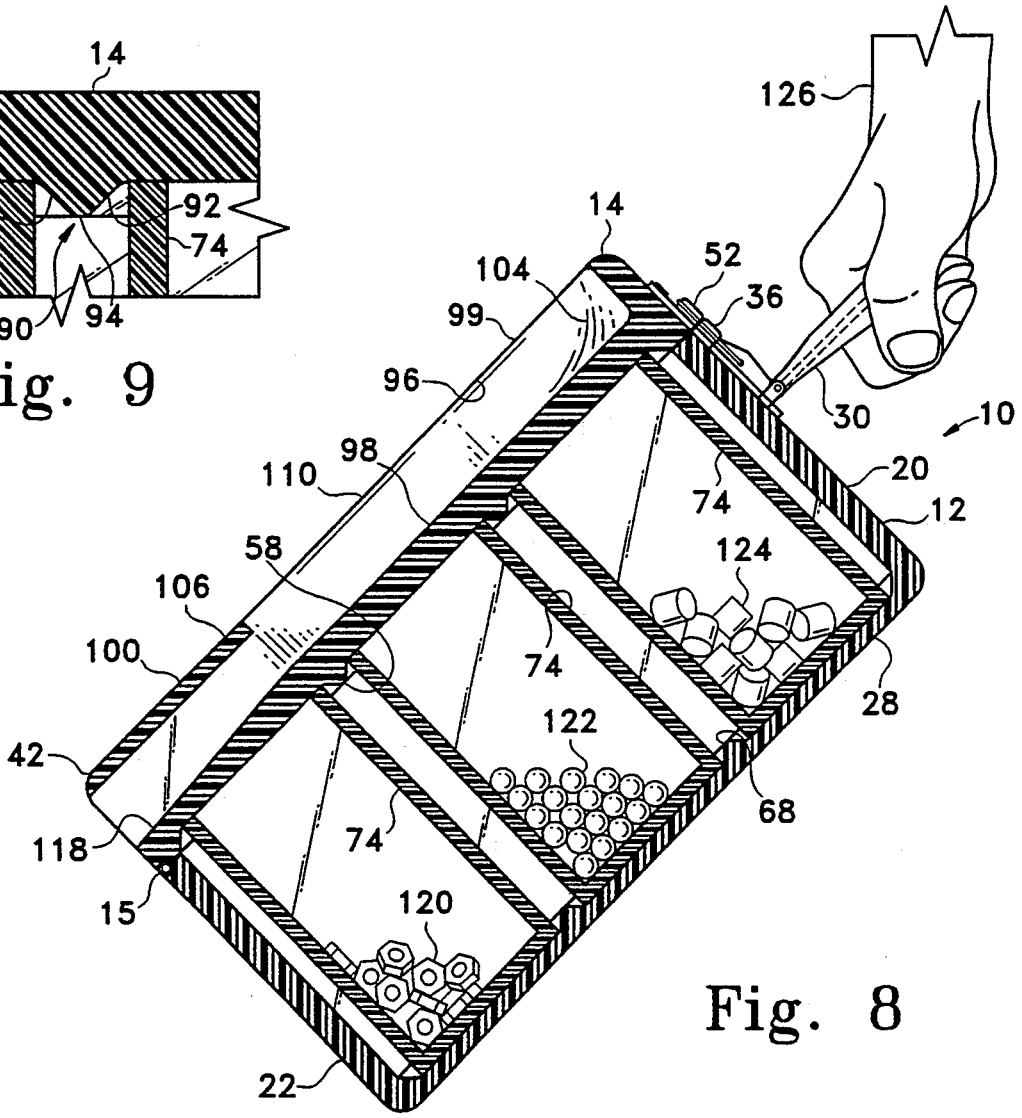
FIG. 8 is a left side cross sectional elevation of the case as in FIG. 7, shown in the process of being picked up by a user and illustrating the effect of the web seals.

Referring to FIGS. 7, 8 and 9, each raised rib member 58, 68 has a cross section in the form of a truncated isosceles triangle having a pair of legs 92 and a truncated apex 94 having a straight line parallel with the bottom wall 28 of the case 12 when the case 12 is closed and latched, with the truncated apex 94 of the triangular cross section of the raised ribs 58, 68 both projecting into the interior of the case 12. The sloping legs 92 of each raised rib 58, 68 allow the webs 56, 64 to locate or center each article container 74 into each cell 60, 72, with minimal effort, that is, the sloping nature of the ribs 58, 68 centers each article container into a matching cell 60, 72, even if the user does not place an article container 72 squarely within a cell. Truncating the apex of the triangular cross section of the raised ribs 58, 68 insures that the raised rib 58, 68 have the strength to withstand rugged use, whereas a sharp point on the ribs 58, 68 might become chipped during use when article containers 74 full of relatively heavy parts are set forcefully into the case 12. It is important to note that the truncated isosceles triangle 90 cross section of the webs 56, 70 are identical, as is the pattern of the webs in the lid 14 and the case 12.

Figure 2:
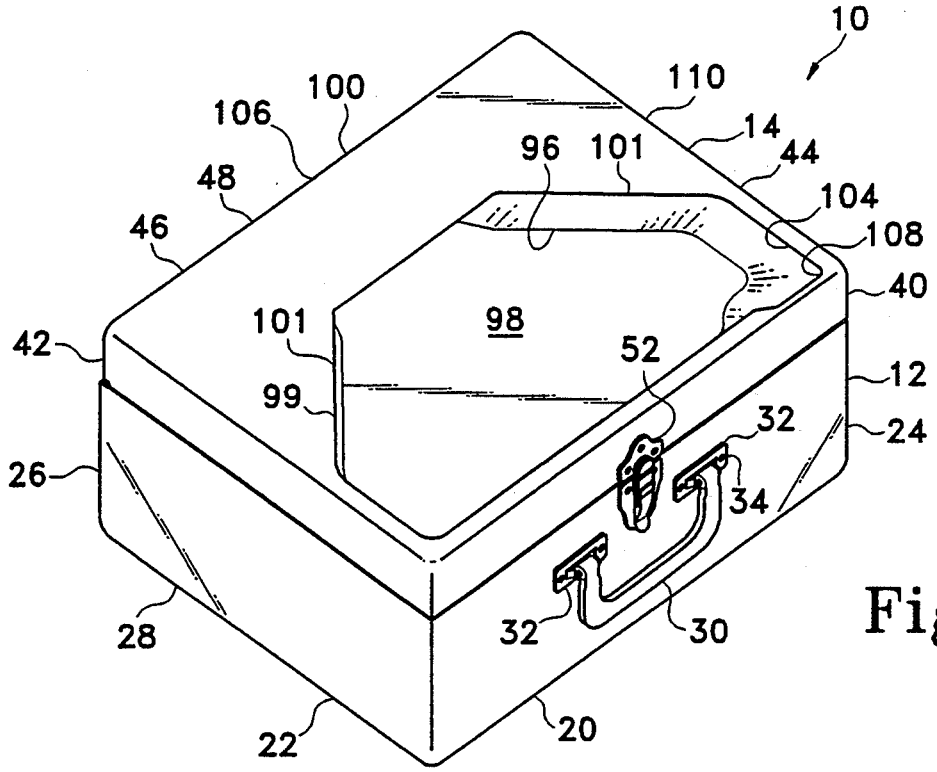
FIG. 2 is a front-right perspective view of the case of FIG. 1 shown in the closed position.
Figure 3:
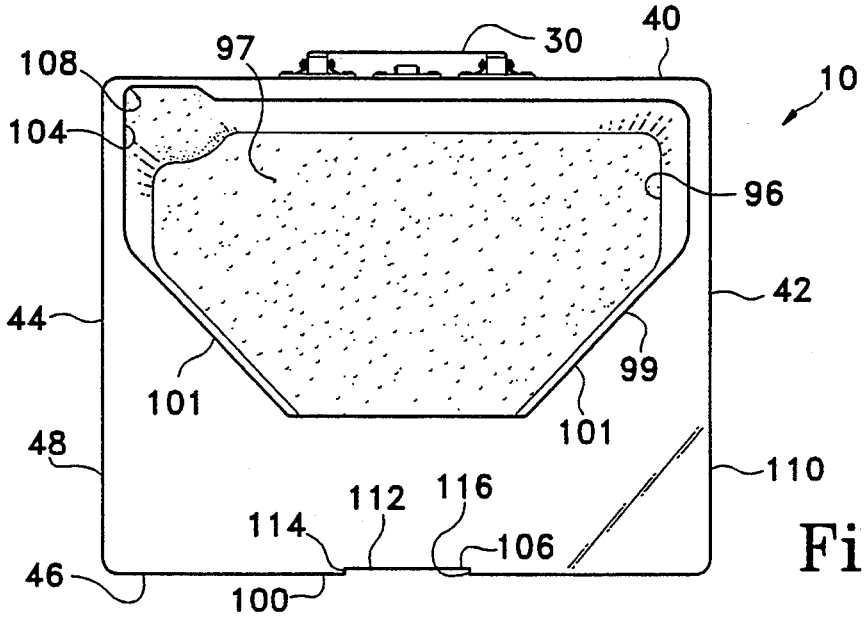
FIG. 3 is a top plan view of the case of FIG. 1 shown with the case in the closed position.

Referring now to FIGS. 2 and 3, there is shown the case 10 in a closed position, revealing an article sorting tray 96 having a recessed sorting floor 98 surrounded by a raised perimeter 99. The raised perimeter 99 includes chute side portions 101 that narrow the sorting tray 96 toward the rear of the case 10, leading to a loading tunnel-chute 100, which has a cover 106 over it and provides a passageway to the rear edge of the lid 14. The cover 106 is a portion of the upper surface of the lid 14. Located in the right-hand front corner 108 of the sorting tray 96 is an article pick up ramp 104, which provides an upward sloping concave ramp extending from the recessed floor 98 of the sorting tray 96 to the upper surface 110 of the lid 14. The article pick up ramp 104 may be conveniently formed at any desired location along the perimeter of the sorting tray 96, or indeed along the entire perimeter of the sorting tray 96, except along the chute side portions 101 and the loading tunnel-chute 100.

Figure 4:
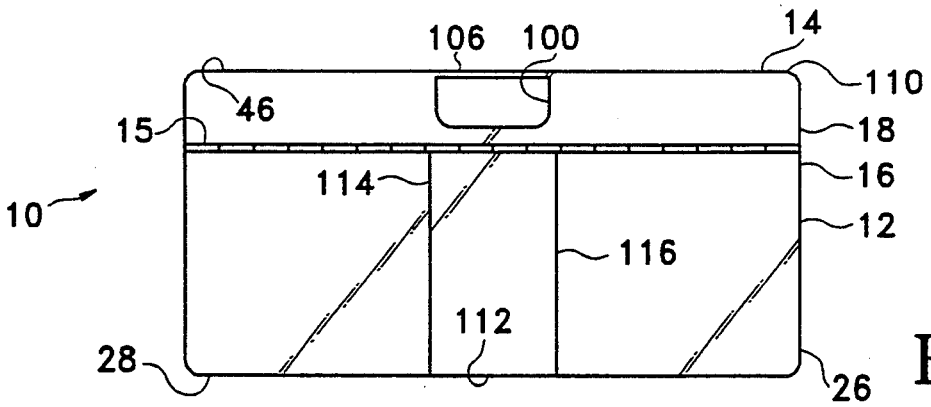
FIG. 4 is a rear elevation of the case of FIG. 1 shown in the closed position.
Figure 5:
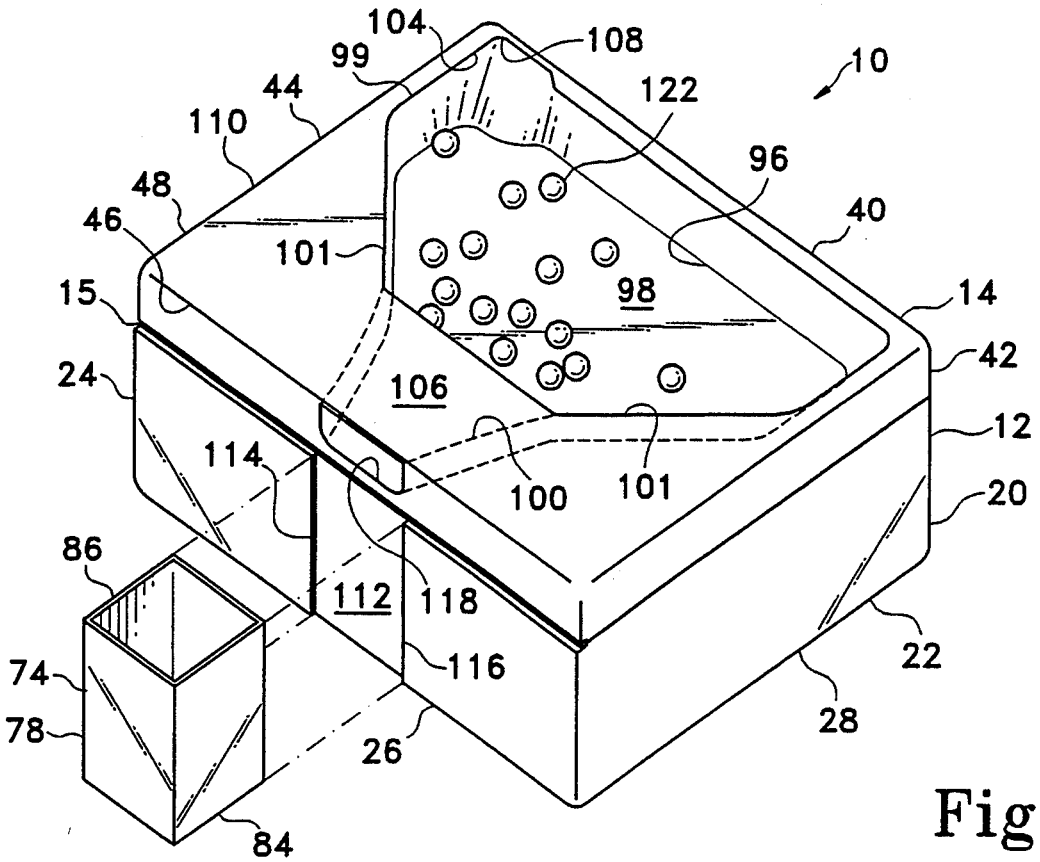
FIG. 5 is a left-rear perspective of the case of FIG. 1 shown in the closed position and illustrating the means for sorting articles.
Figure 6:
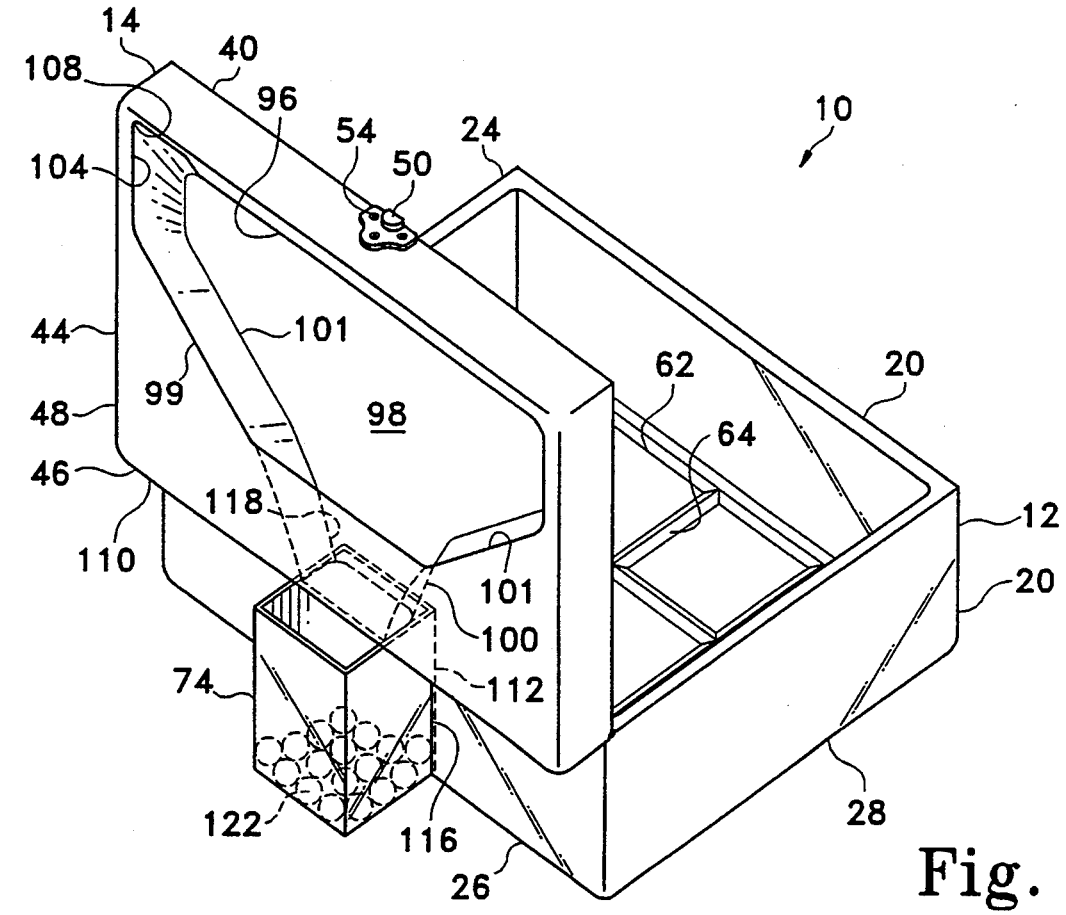
FIG. 6 is a left-rear perspective of the case illustrating the return of sorted articles to a container for storing within the case.

Referring now to FIGS. 4, 5 and 6, the loading tunnel-chute 100 and its operation are more clearly shown. A recessed channel 112 defined by a pair of spaced parallel vertical channel edges 114, 116 is formed into the rear wall 26 of the body 12 vertically aligned with and below (as viewed in FIG. 4, for example) the loading tunnel chute 100. The distance between the vertical channel edges 114, 116 is just wide enough to accommodate a side wall of the article container 74 (with all four side walls of the article container 74 being the same width, as discussed above). The recessed channel 112 is visible in FIG. 3 because the rear wall 46 of the lid 14 is slightly recessed from the rear wall 26 of the body 12, or, in other words, the top plan of the lid 14 is slightly shorter from front to back than the plan of the body 12, but the front walls 20 of the body and 40 of the lid 14 are vertically aligned when the case 12 is closed. This offset of the rear wall 46 of the lid 14 from the rear wall 26 of the body 12, operating in conjunction with the recessed channel 112, allows articles to be conveniently returned to an article container 74 from the sorting tray 96, as described in detail below.

In sorting or otherwise selecting an article from among the contents of an article container 74, the user dumps all or part of the contents of the article container 74 into the sorting tray 96 and spreads them around for ready visual inspection, such as the ball bearings 122 in FIG. 5, with the lid 14 in the closed, i.e., horizontal position, and the case 12 resting on a substantially horizontal surface. When the desired article or part is located, the user simply picks it up. If the article is difficult to pick up, as for example, metal flat washers can be, then the user merely presses on the article with a thumb or finger and drags it across the recessed floor 98 of the sorting tray 96 toward and then onto the article pick up ramp until the article slides to the right-hand front corner 108 of the sorting tray 96, which is also the corner of the case 12. In this position, the article is partially extended over the edge of the case 12 and is then easily grasped between a finger and thumb and moved to the place where it will be used. As shown in FIG. 3, the recessed floor 98 of the sorting tray 96 includes a pebbled surface 97, or other type of friction ridges or material, such as a rubber pad, to increase the friction between the sorting tray 96 and the articles being manipulated, to make it easier to move an article, particularly a smooth, slippery article, across the floor 98. The pebbling 97 also extends to and covers the article pick up ramp 104.

When sorting or selecting has been completed, the user typically wants to return the articles not selected to an article container 74, as illustrated relative to the ball bearings 122 in FIG. 6. Returning the articles not selected to an article container 74 is very easily accomplished by placing the article container in the recessed channel 112, while resting the bottom of the article container 74 on whatever surface the case 12 itself is resting on, and gradually raising the lid 14 from a horizontal position, causing the articles in the sorting tray 96 to side toward the rear of the case 12, where they are directed into the loading tunnel-chute 100 by the chute side portions 101 of the raised perimeter 99 of the sorting tray 96. The articles then fall directly from the loading tunnel-chute 100 into the awaiting article container 74. The cover 106 on the loading tunnel-chute 100 prevents articles from spilling over the back edge of the article container 74.

Referring now to FIG. 7, 8, during development of the case 12, it was found that articles might occasionally jam in the loading tunnel-chute 100 if the lid 14 was raised to quickly. This difficultly was overcome by providing a sloping floor portion 118 of the loading tunnel-chute 100, which breaks downward toward the rear of the case 10 at an angle of from about 5–15 degrees from the recessed floor 98 of the sorting tray 96. The sloping floor portion 118 insures that the available acceleration of each article due to gravity will be greater when an article is inside the tunnel-chute 100 than when the same article is on the floor 98 proper, regardless of the angle of the lid 14 to the horizontal. Therefore, articles will move more quickly through the tunnel-chute 100 than they will from the floor 98 toward the tunnel-chute 100, thereby preventing articles from jamming in the tunnel-chute 100. Field testing has revealed that this result is achieved regardless of the shape, surface characteristics (e.g., knurled, threaded, and so forth) and other characteristics of the articles being sorted.

Referring now to FIGS. 7 and 8, each container 74 may contain different articles, which may comprise different sizes of the same type articles, such as the nuts 120, ball bearings 122 or the bushings 124. Alternatively, of course, each article container 74 may contain different types of articles, such as buttons, thread, washers, electrical parts, and so forth.

As clearly shown in both FIGS. 7 and 8, when the lid 14 is closed and the case 12 is latched, the top edges of each article container 74 is sealed by the web 56 and each article container 74 is restrained from lateral movement by the web 56 in the lid 14 and the aligned web 64 in the bottom inside surface of the body 12, thereby preventing the contents of any article container 74 from escaping from the article container 74 or mixing with other articles from other article containers 74.

Referring now to FIG. 8, when the user wants to transport the case 12 to a different location, the case 12 is latched and the user grasps the handle 30 with his hand 126 and picks up the case and carries it like a suitcase or briefcase to the different location. The handle 30 pivots within the brackets 32 for easy carrying.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

I claim:

1. A case for storing, organizing and sorting small articles, comprising:

a. a body having a hinged lid attached thereto;

b. a plurality of removable containers seated within said case, each said removable container further comprising an open top;

c. means for sealing the tops of said removable containers when said case is closed; and d. means for preventing movement of said removable containers within said case when said case is closed, said movement preventing means further comprising a plurality to raised webs in a bottom interior surface of said body, said webs defining a plurality of cells, with each said cell receiving and surrounding a lower perimeter of each said removable container.

2. A case for storing, organizing and sorting small articles in accordance with claim 1 wherein said sealing means further comprises a plurality of raised webs in an interior surface of said lid, said webs defining a plurality of cells for surrounding a perimeter of said removable containers when said lid is closed, each said web further comprises a pair of inwardly sloped walls creating a web having a triangular cross section, whereby each said container is self-centering within each said respective cell.

3. A case for storing, organizing and sorting small articles in accordance with claim 1 further comprises a relationship between said cells and said webs in said lid, said bottom interior surface of said body, and said removable containers that said cell prevents articles from spilling from said removable containers, said relationship further comprising each said web in said lid and in said bottom interior surface of said body further comprises a pair of inwardly sloped walls projecting toward an interior space of said case and creating a web having a triangular cross section, whereby each said container is self-centering within each said respective cell in said lid and in said bottom surface when said lid is closed and said cells in said lid and in said bottom surface are superposed.

4. A case for storing, organizing and sorting small articles, comprising:

a. a body having a hinged lid attached thereto;

b. a plurality of removable containers seated within said case, each said container further comprising an open top;

c. means for allowing sorting and selection of articles from said removable containers contained in said lid; and d. means for returning articles to said removable containers contained in said lid.

5. A case for storing, organizing and sorting small articles in accordance with claim 4 wherein said sorting and selecting means further comprises a sorting tray in an upper surface of said lid.

6. A case for storing, organizing and sorting small articles in accordance with claim 5 wherein said sorting tray further comprises a recessed sorting floor and a raised perimeter.

7. A case for storing, organizing and sorting small articles in accordance with claim 6 wherein said sorting tray further comprises an article pick up ramp rising from said recessed floor of said sorting tray to an upper surface of said lid.

8. A case for storing, organizing and sorting small articles in accordance with claim 7 further comprising a high-friction surface on said sorting tray and said article pick up ramp.

9. A case for storing, organizing and sorting small articles in accordance with claim 4 wherein said article returning means further comprises a tunnel-chute in communication with said sorting tray, said tunnel-chute and chute side portions formed along a portion of said sorting tray perimeter and leading to said tunnel-chute and said tunnel chute provides a passageway to a rear edge of said lid.

10. A case for storing, organizing and sorting small articles in accordance with 4 wherein said article returning means further comprises a recessed channel in a rear wall of said body of said case, said recessed channel being defined by a pair of parallel vertical edges, and said removable containers further comprise four side walls of equal dimensions and a width of any said side wall fits within said recessed channel.

11. A case for storing, organizing and sorting small articles in accordance with claim 10 wherein said tunnel-chute further comprises a sloping floor portion breaking downward toward said rear of said case from said sorting floor at an angle in the range of 5–15 degrees.

12. A case for storing, organizing and sorting small articles in accordance with claim 11 wherein a rear wall of said lid is recessed toward a front wall of said case relative to a rear wall of said body.

13. A case for storing, organizing and sorting small articles in accordance with claim 4 further comprising a handle pivotally fastened to a front wall of said body.

14. A case for storing, organizing and sorting small articles comprising:

a. a body having a hinged lid attached thereto;

b. a plurality of removable containers seated within said case, each said removable container further comprising an open top; and c. means for sealing the tops of said removable containers when said case is closed;

d. means for preventing movement of said removable containers within said case when said case is closed;

e. means for allowing sorting and selection of articles from said removable containers contained in said lid; and f. means for returning articles to said removable containers contained in said lid.

15. A case for storing, organizing and sorting small articles in accordance with claim 14 wherein said sorting and selecting means further comprises a sorting tray in an upper surface of said lid.

16. A case for storing, organizing and sorting small articles in accordance with claim 15 wherein said sorting tray further comprises an article pick up ramp rising from said recessed floor of said sorting tray to an upper surface of said lid.

17. A case for storing, organizing and sorting small articles in accordance with claim 14 wherein said article returning means further comprises a tunnel-chute in fluid communication with said sorting tray, said tunnel-chute and chute side portions formed along a portion of said sorting tray perimeter and leading to said tunnel-chute and said tunnel chute provides a passagageway to a rear edge of said lid.

18. A case for storing, organizing and sorting small articles in accordance with claim 14 wherein said article returning means further comprises a tunnel-chute in communication with said sorting tray, said tunnel-chute and chute side portions formed along a portion of said sorting tray perimeter and leading to said tunnel-chute and said tunnel chute provides a passagageway to a rear edge of said lid.

19. A case for storing, organizing and sorting small articles in accordance with 14 wherein said article returning means further comprises a recessed channel in a rear wall of said body of said case, said recessed channel being defined by a pair of parallel vertical edges, and said removable containers further comprise four side walls of equal dimensions and a width of any said side wall fits within said recessed channel.

20. A case for storing, organizing and sorting small articles in accordance with claim 14 wherein said tunnel-chute further comprises a sloping floor portion breaking downward toward said rear of said case from said sorting floor at an angle in the range of 5–15 degrees.

* * * * *